US011629729B2

(12) United States Patent
Hueser et al.

(10) Patent No.: US 11,629,729 B2
(45) Date of Patent: Apr. 18, 2023

(54) PUMP, IN PARTICULAR FOR A LIQUID CIRCUIT IN A VEHICLE

(71) Applicant: HELLA GmbH & Co. KGaA, Lippstadt (DE)

(72) Inventors: Theodor Hueser, Geseke (DE); Ciprian Ionel Ivanut, Timis (RO); Thorsten Wille-Riess, Bremen (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 17/185,489

(22) Filed: Feb. 25, 2021

(65) Prior Publication Data

US 2021/0180610 A1 Jun. 17, 2021

Related U.S. Application Data

(63) Continuation of application No. PCT/EP2019/076566, filed on Oct. 1, 2019.

(30) Foreign Application Priority Data

Oct. 10, 2018 (DE) ..... 10 2018 125 040.1

(51) Int. Cl.
*F04D 29/42* (2006.01)
*F04D 29/08* (2006.01)

(52) U.S. Cl.
CPC ..... *F04D 29/426* (2013.01); *F04D 29/086* (2013.01)

(58) Field of Classification Search
CPC .... F04D 29/086; F04D 29/42; F04D 29/4206; F04D 29/426; F04D 29/40; F04D 29/44
See application file for complete search history.

(56) References Cited

U.S. PATENT DOCUMENTS 3,079,127 A * 2/1963 Rowlett ..... F01D 17/143 415/48
3,982,856 A 9/1976 Hehl
5,071,140 A 12/1991 Quevedo del Rio
(Continued)

FOREIGN PATENT DOCUMENTS

CN 201236837 Y 5/2009
DE 102010035861 A1 3/2012
(Continued)

OTHER PUBLICATIONS

International Search Report dated Dec. 10, 2019 in corresponding application PCT/EP2019/076566.

*Primary Examiner* — Justin D Seabe
*Assistant Examiner* — Sang K Kim
(74) *Attorney, Agent, or Firm* — Muncy, Geissler, Olds & Lowe, P.C.

(57) ABSTRACT

A pump, in particular for a fluid circuit in a vehicle, for example a coolant pump with a multi-part housing that has a pump chamber, wherein an impeller is arranged in the pump chamber, wherein the pump chamber is bounded by a pump housing and a further housing part of the multi-part housing, wherein the pump housing and the further housing part each have a flange surface that rest against one another, and wherein one of the two flange surfaces has at least one annular groove and the other of the two flange surfaces has at least one circumferential web which engages in the annular groove.

7 Claims, 10 Drawing Sheets

(56) References Cited

U.S. PATENT DOCUMENTS

| | | | | |
|---|---|---|---|---|
| 5,269,664 | A * | 12/1993 | Buse | F04D 29/061 417/420 |
| 6,726,447 | B2 * | 4/2004 | Lutz | F01D 17/143 415/158 |
| 7,607,888 | B2 | 10/2009 | Hori et al. | |
| 8,282,367 | B2 | 10/2012 | Ihle et al. | |
| 10,167,874 | B2 * | 1/2019 | Danguy | F01D 5/02 |
| 10,393,120 | B2 | 8/2019 | Reul et al. | |
| 10,962,026 | B2 * | 3/2021 | Mochizuki | F04D 29/426 |
| 2008/0075586 | A1 * | 3/2008 | Fukuki | F04D 1/063 415/177 |
| 2010/0215485 | A1 * | 8/2010 | Childe | F04D 29/4226 415/203 |
| 2019/0010952 | A1 * | 1/2019 | Welschinger | F04D 29/086 |
| 2020/0003215 | A1 | 1/2020 | Geue et al. | |
| 2020/0300250 | A1 * | 9/2020 | Torii | F04D 29/043 |
| 2021/0123455 | A1 * | 4/2021 | Lee | F04D 29/605 |

FOREIGN PATENT DOCUMENTS

| | | | |
|---|---|---|---|
| DE | 102007016255 | B4 | 11/2012 |
| DE | 102011055599 | A1 | 5/2013 |
| DE | 102013017976 | A1 | 6/2015 |
| WO | WO2018162326 | A1 | 9/2018 |

* cited by examiner 110
40
30
202
70
80
M
603
60
M
604
304
303
E
110
302
301
607
50
201
20
R
203
102
101
100
104
204
10
902
103
601
901
206
90
P
204
S
100
M
607
50
301
R 40
30
70
607
60
202
50
R
20
203
208
201
104
10
204
M
103
80
E
604
303
M
603, 606
601
605
304
301
202
101
S
204
207
206
90
901
902

PUMP, IN PARTICULAR FOR A LIQUID CIRCUIT IN A VEHICLE

This nonprovisional application is a continuation of International Application No. PCT/EP2019/076566, which was filed on Oct. 1, 2019, and which claims priority to German Patent Application No. 10 2018 125 040.1, which was filed in Germany on Oct. 10, 2018 and which are both herein incorporated by reference.

BACKGROUND OF THE INVENTION

Field of the Invention

The present invention relates to a pump, in particular for a fluid circuit in a vehicle, for example a coolant pump.

Description of the Background Art

A pump is known from document DE 10 2011 055 599 A1. It has a multi-part housing with a pump chamber, a motor chamber and an electronics chamber. In the pump chamber, an impeller is arranged, which is driven by a motor which is arranged in the motor chamber. An electrical circuit is provided in the electronics chamber with which the motor can be controlled and/or regulated.

The fluid conveyed by a pump is compressed by the rotation of the impeller. The impeller conveys the fluid from the inside to the outside into a spiral space. Viewed in the radial direction, this spiral space is located outside of the impeller between the impeller and the wall of the pump chamber. The spiral space absorbs the fluid emerging from the impeller and guides it to the outlet of the pump chamber or the pump. The flow of the fluid follows a pressure drop towards the outlet. The pressure is built up by the rotation of the impeller. The pressure prevailing in the spiral space can cause fluid to escape from the pump chamber in which the fluid passes, for example, between the pump housing and the further housing part of the pump that bounds the pump chamber.

SUMMARY OF THE INVENTION

It is therefore an object of the present invention to to improve the pump, in particular the pump housing, in such a manner that there are only minor unwanted pressure and fluid losses.

This object is achieved according to the invention in that the pump housing and the further housing part each have a flange surface and these flange surfaces rest against each other and that one of the two flange surfaces has at least one annular groove and the other of the two flange surfaces has at least one circumferential web that engages in the annular groove.

If the annular groove and the circumferential web were not provided, instead of the annular groove and the circumferential web, flat surfaces of the pump housing and the motor housing would rest against one another. The annular groove and the circumferential web, on the other hand, create a kind of labyrinth seal, which ensures an improved seal between the pump chamber and the space outside the pump even without an additional seal.

A further effect of the annular groove and the web is that an expansion of the pump housing is reduced in the pump chamber, particularly in a spiral space of the pump chamber.

The pump housing can have a flange on which the flange surface with the circumferential web is provided. The further housing part can also have a flange, on which the flange surface with the annular groove can be provided. The flanges can be fastened together with screws.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
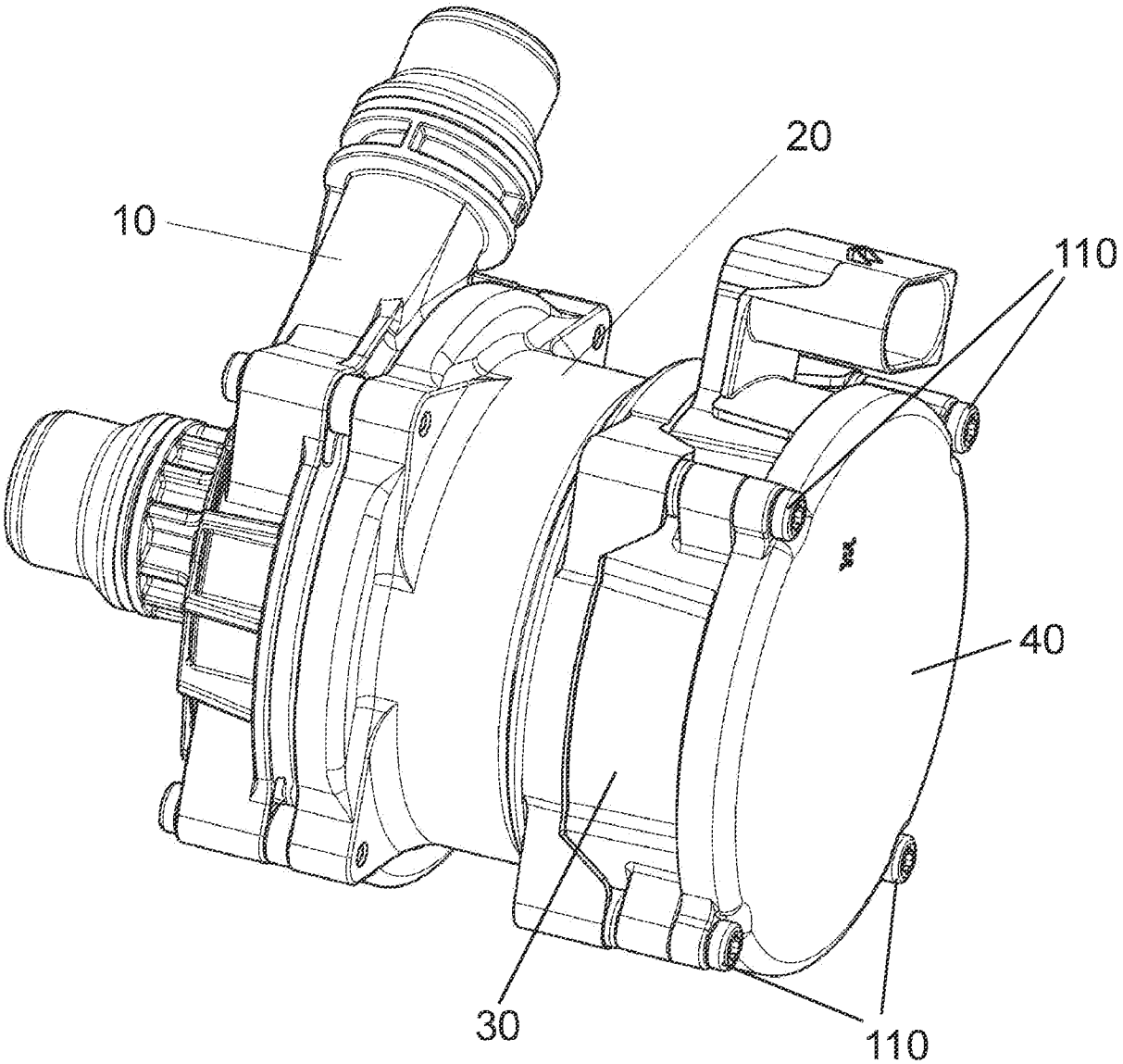
FIG. 1 is a perspective view of a first pump according to the invention.
Figure 2:
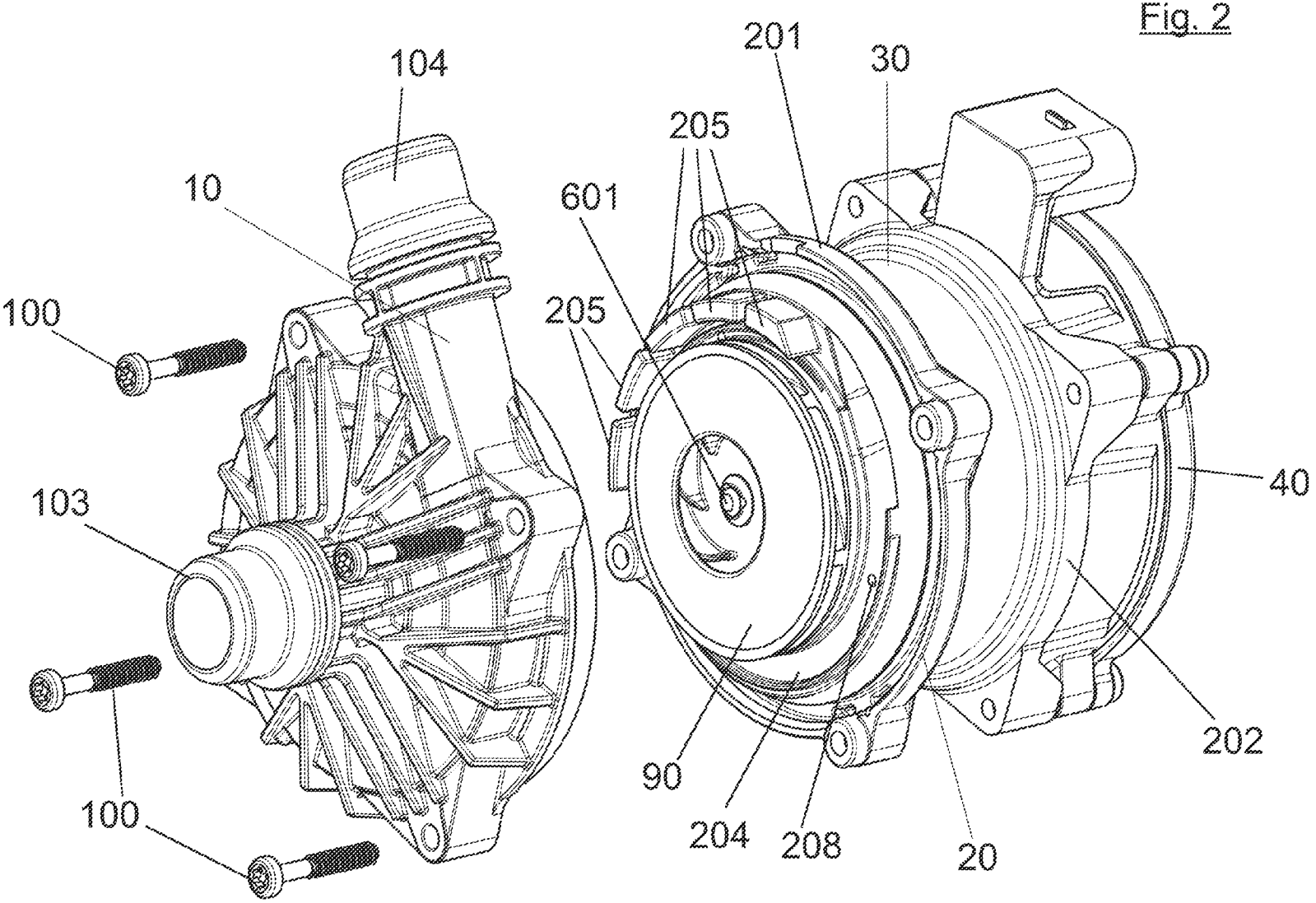
FIG. 2 is a perspective exploded view of the first pump.
Figure 3:
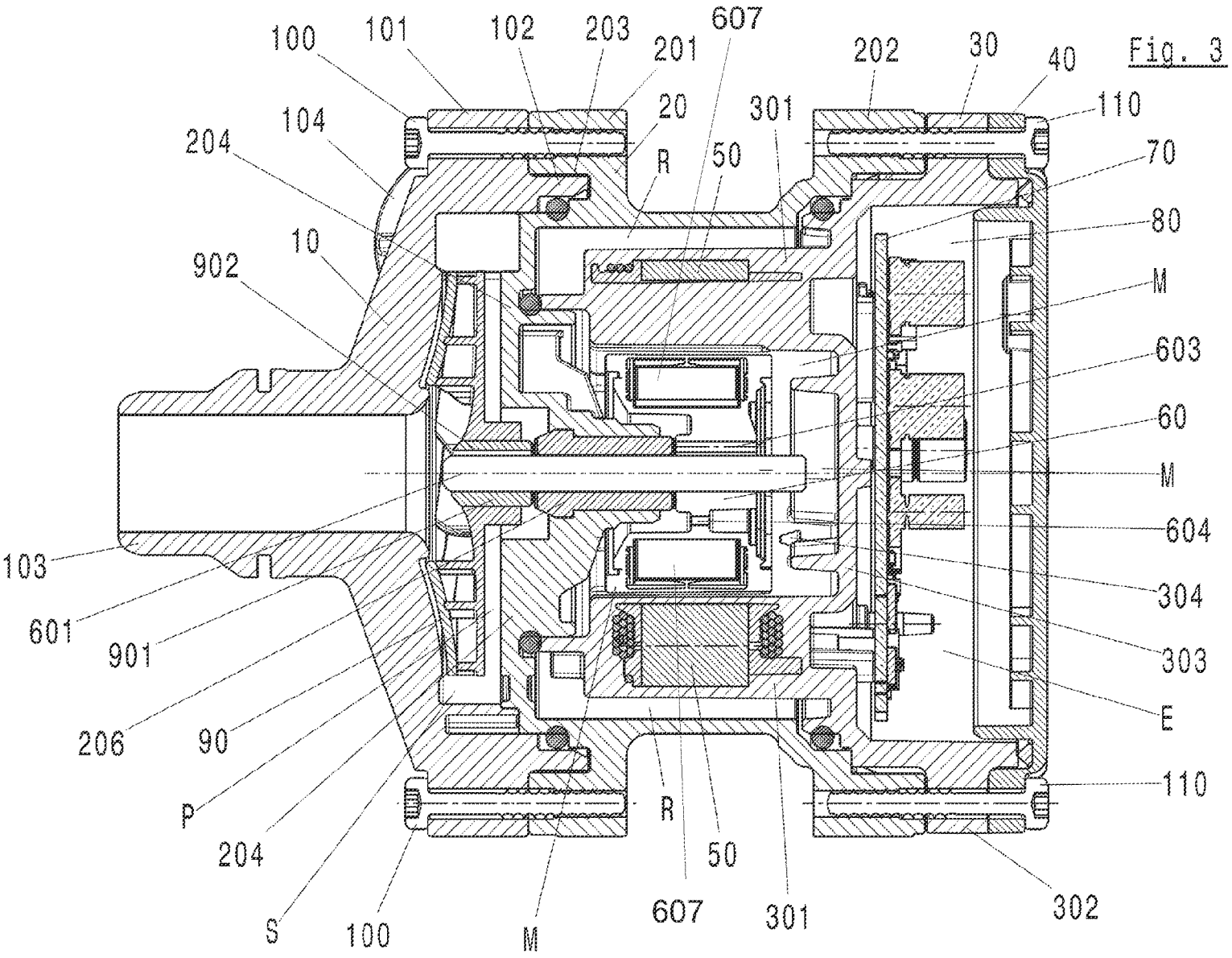
FIG. 3 is a longitudinal section through the first pump.
Figure 4:
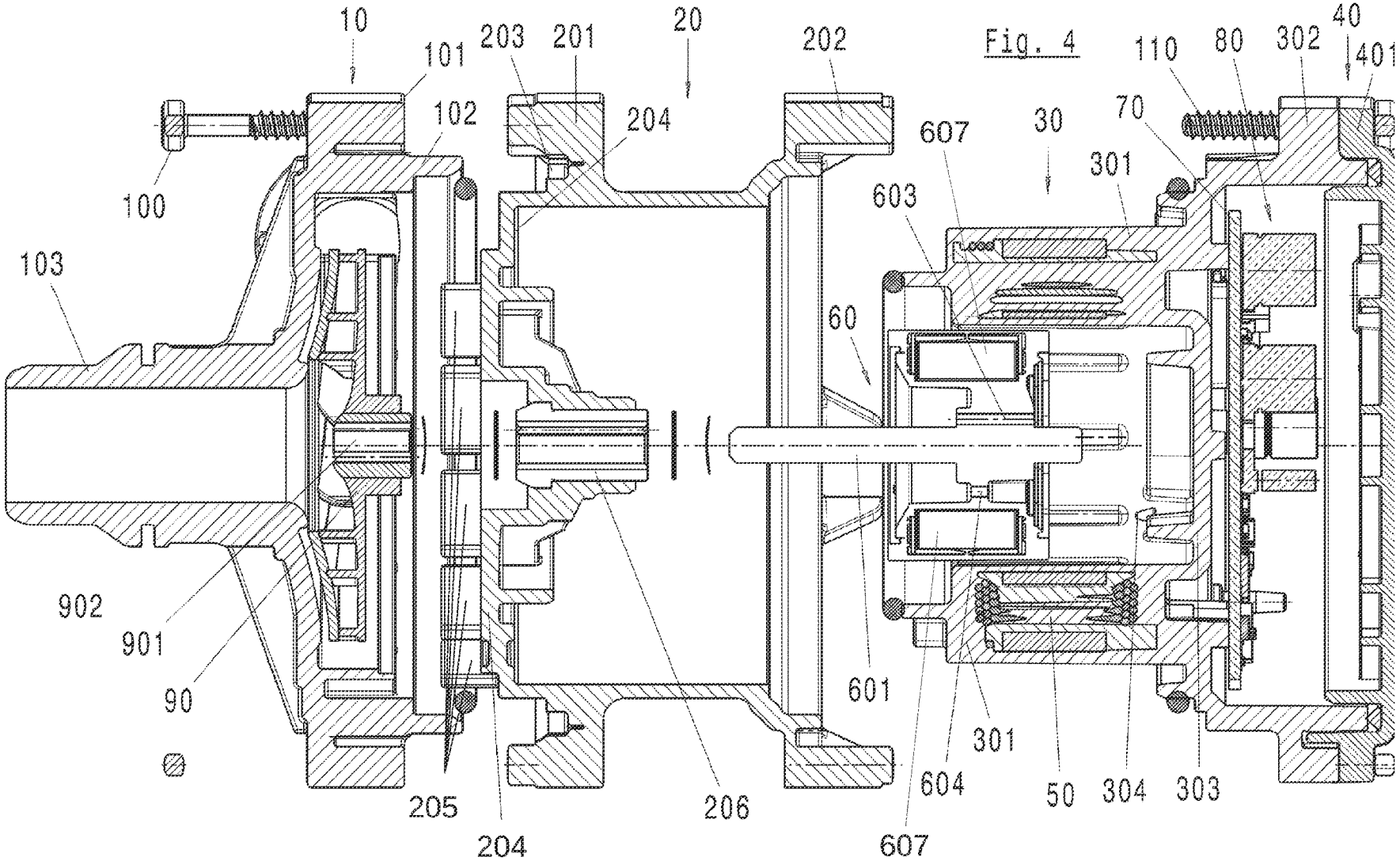
FIG. 4 is a longitudinal section through the first pump in an exploded view.

The pumps according to the invention shown in the figures are very similar and are only different in a few parts or even only in one part. Thus, with reference to FIGS. 1 to 4 and 9 and 10, initially the first pump shown according to the invention will be described prior to the differences between the second, third and fourth inventive pumps being discussed.

The first pump has a multi-part housing that comprises a pump housing 10, a motor housing 20, an electronics housing 30 and a cover 40, wherein a stator 50 of a motor of the pump is provided in the electronics housing 30. The motor of the pump is completed by a rotor 60 which is rotatably mounted on the motor housing 20 and in which the stator 50 is immersed. The stator 50, in turn, is immersed in the motor housing 20. Further, an interconnect device 70 is provided on which an electronic circuit 80 is provided, via which the motor is supplied with electrical energy and is controlled. An electronics chamber E in which the interconnect device 70 and the circuit 80 are arranged is bounded by the electronics housing 30 and the cover 40 of the housing.

The housing parts can be made of plastic, for example Vyncolit. The stator 50 is molded in the electronics housing 30, preferably in a skirt 301 of the electronics housing 30.

The pump housing 10, the electronics housing 30 and the cover 40 each have a flange 101, 302, 401. The motor housing 20 has two flanges 201, 202, namely a first on the side facing the pump housing 10 and a second on the side facing the electronics housing 30 and the cover 40.

The pump housing 10 and the motor housing 20 are connected to each other by screws 100, which are guided through the flange 101 of the pump housing 10 into the first flange 201 of the motor housing 20. The cover 40 and the electronics housing 30 and the electronics housing 30 and the motor housing 20 are connected to each other by screws 110, which are guided through the flange 401 of the cover 40 and the electronics housing 30 into the second flange 202 of the motor housing 20.

In order to achieve a more pressure-resistant connection between the pump housing 10 and the motor housing 20, the flange 101 of the pump housing 10 has a circumferential web 102, which positively engages in an annular groove 203 provided in the first flange 201 of the motor housing. As a result, an expansion of the pump housing 10 and the motor housing 20 during operation of the pump due to the pressure prevailing there can be avoided or at least reduced.

The pump has an impeller 90 which is rotatably disposed in the pump housing 10 and for this purpose is attached to a shaft 601 of the rotor 60, which protrudes into the pump housing 10.

The pump housing 10 and a wall 204 of the motor housing, namely the wall that is penetrated by the motor shaft 601, include a pump chamber P in which the impeller 90 is disposed. The pump chamber P can be connected via an intake port 103 of the pump housing 10 to a line via which the fluid to be pumped is sucked in. The intake port 103 is arranged coaxially to a rotational axis of the rotor 60.

Figure 5:
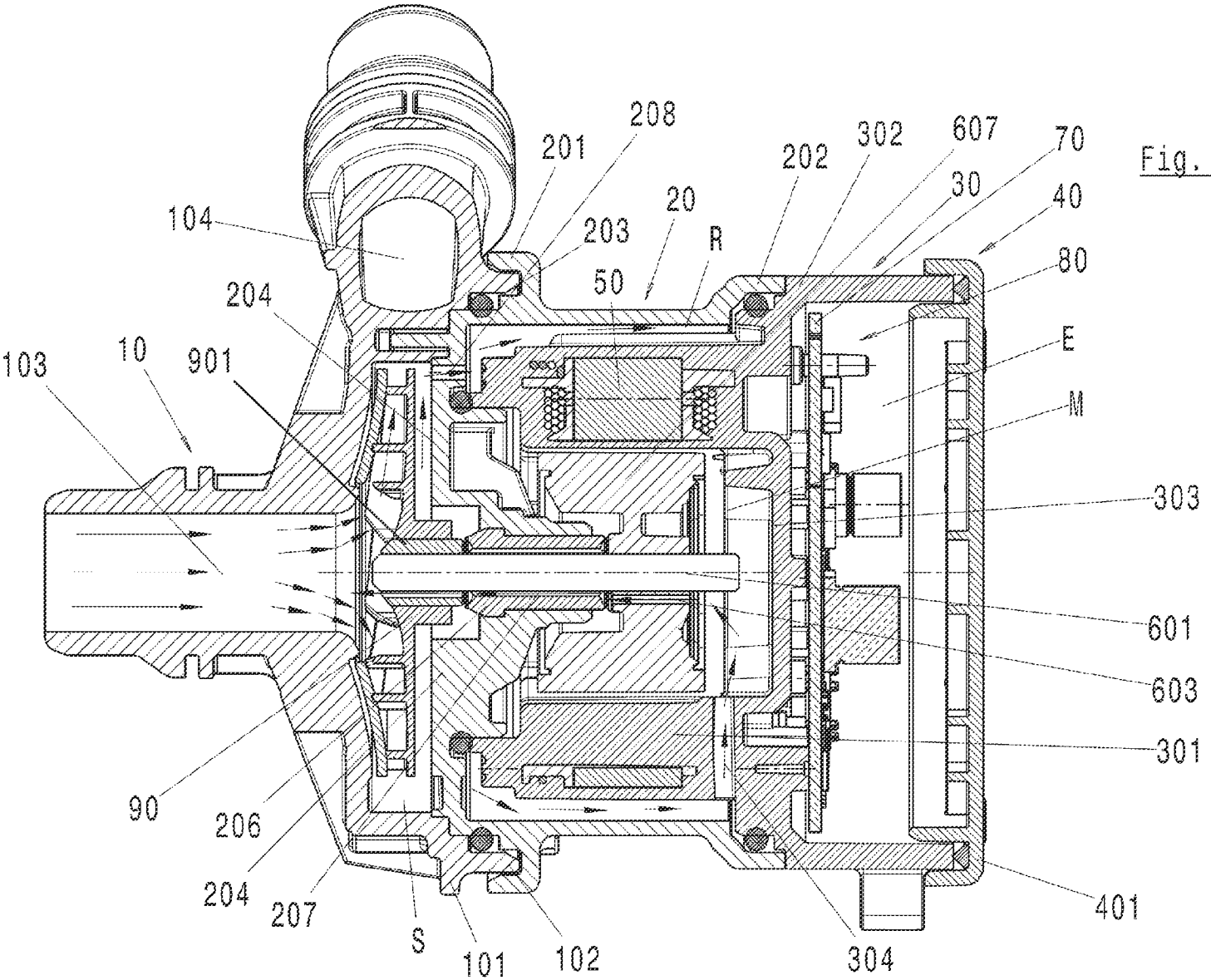
FIG. 5 is a longitudinal section through a second pump according to the invention.

The pump chamber P can be connected via an outlet port 104 to a line into which the pumped fluid is pressed. An outer wall of the pump housing 10 and the impeller 90 bound a spiral space S, which expands in a spiral manner towards the outlet of the pump chamber. The impeller 90 is designed in a manner known per se, for example in a manner shown in the document DE 10 2011 055 599 A1, FIG. 2, 3 or 5, which is referenced for a more detailed description of an impeller 90 which can be used for an inventive pump.

The impeller 90 has a bush, preferably made of metal, with a central through hole into which the rotor shaft 601 is inserted so that the impeller 90 with the bush 901 is seated on the rotor shaft 601 in a torque-proof manner, preferably with a press fit. Parallel to the central through hole of the bush 901, the bush has a plurality of grooves 902, which, together with the rotor shaft 601, form through holes from which a fluid can flow from a side of the impeller 90 facing the motor housing 20 to a side of the impeller 90 facing the intake. In the example shown, there are three grooves 902.

To the extent that the spiral space S of the pump chamber P expands in a spiral manner, the wall of the pump housing 10 bounding the pump chamber P in the radial direction tapers off. In this wall, recesses 105 are provided which are open in the direction of the motor housing 20. In the examples shown in the figures, these recesses 105 have approximately the shape of a straight cylinder with a base area which is similar to the sector of a circular ring. In the illustrated examples, the base area of the cylinder is thus similar to a sector of a circular ring, wherein the inner walls of the recesses 105 follow the spiral shape of the radial boundary of the pump chamber P or the spiral space S of the pump chamber P. This results in recesses that taper in the circumferential direction 105. The recesses 105 thus also differ from one another.

Complementary to the recesses 105, protrusions 205 are provided on the wall 204 facing the pump housing 20 through which the rotor shaft 601 extends, which protrude into the recesses 105 in the assembled state of the pump.

Due to the recesses 105 and the complementary protrusions 205, the pump housing 10 and the motor housing 20 can only be assembled in one specific position when the pumps are installed.

A specific position of the pump housing 10 and the motor housing 20 could also be achieved in other ways.

The recesses 105 and protrusions 205 also have another effect. The area of the pump housing 10 and the motor housing 20, in which the recesses 105 and the protrusions 205 are provided, separates the high-pressure area and the low-pressure area of the pump chamber P and the spiral space S. These must be sealed against each other as well as possible, so that a flow of fluid past the fluid circuit via the lines connected to the pump is prevented as much as possible and the pump can work as effectively as possible. If the protrusions 205 and the recesses 105 were not provided, flat surfaces of the pump housing 10 and the motor housing 20 would rest against one another instead. The protrusions 205 and recesses 105, on the other hand, create a type of labyrinth seal which ensures an improved seal between the high-pressure area and the low-pressure area even without an additional seal.

In the already mentioned wall 204, through which the rotor shaft 601 protrudes, a bush 206 is formed, which serves as a bearing for the rotor shaft 601. It is also possible that a bush 206 for mounting the rotor shaft is inserted into the above-mentioned wall 204 and is firmly connected to the rest of the motor housing 20.

The bush 206 has a through hole whose cross section is fitted to the rotor shaft 601. Axially in the wall of the through hole, one or more, preferably two, grooves 207 (not visible in FIG. 3) are provided through which a fluid can flow between the pump chamber P and a motor chamber M, which is bounded by the motor housing 20 and the skirt 301 and vice versa when the rotor shaft 601 is in use. Small amounts of the fluid passed through the grooves 207 are carried along by the shaft 601 when the rotor rotates and ensure lubrication between the rotor shaft 601 and the bush 206.

In the wall 204 through which the rotor shaft 601 protrudes, one or more through holes 208 are provided in the area of the spiral space S—in the examples shown, there are three through holes 208—which create a connection between the spiral space S and an annular chamber R bounded by the motor housing 20, the skirt 301 and an end wall 303 of the electronics housing 30. A fluid can be conveyed into the annular chamber R through the through holes 208 from the spiral space, which is located on the high-pressure side of the impeller 90.

The annular chamber R is connected to the motor chamber M by one or more radial through holes 304 in the skirt 301. The through holes 304 are provided in the vicinity of the end wall 303. A fluid that passes from the annular chamber R into the motor chamber M can be conveyed through the motor chamber M, for example through a gap between the rotor 60 and the skirt 301, to the side of the motor chamber M facing the rotor 60 of the pump chamber P. The aforementioned grooves in the bearing bush 206 of the rotor shaft 601 and the grooves 902 in the bush 901 of the impeller 90 allow for the fluid to be conveyed to the intake side of the impeller 90, i.e. to the low-pressure side of the impeller 90. There is thus a continuous connection from the spiral space S, i.e. the high-pressure side of the pump chamber P, via the through holes 208 between the spiral space S and the annular chamber R into the annular chamber R, from there through the through holes 304 between the annular chamber R and the motor chamber into the motor chamber M and from the motor chamber M via the grooves 207 in the bearing bush 206 and the grooves 902 in the bush 901 of the impeller 90 to the intake side of the impeller 90, of the low-pressure side of the pump chamber P. When the pump is in operation, a fluid flow along this path which, although significantly smaller than the flow conveyed by the pump into the outlet, is so large that it sufficiently cools the pump in a nominal operation.

When the pump is cooled by a flow of fluid along the described flow path, air that is in the fluid circuit may collect in a space between the rotor 60 and the end wall 303 of the electronics housing 30, for whatever reason. The air collected in this room can barely escape from this room or be conveyed from this room. Both the fluid and the air in this space are set in rotation during operation of the pump due to the movement of the rotor. The centrifugal forces thereby occurring lead to a stratification in this space corresponding to the density of the media that have accumulated there. This leads to the fact that the air collects in the middle of the space, while the fluid collects in the outer area and can be conveyed from there through the annular gap between stator 50 and rotor 60.

The accumulation of air has disadvantages for the cooling of the pump, in particular for the cooling of the rotor 60 and the electronic circuit 80.

This can be remedied if the shaft 601 of the rotor 60 is provided with a center bore. This could extend over the entire length of the shaft 60 and thus connect the space between the rotor 60 and the end wall 303 of the electronics housing with the low-pressure side of the pump chamber P. It is also possible that the center bore extends only from the end of the shaft 601 facing this space to the other side of the rotor 60. The air can then be conveyed from one side of the rotor 60 to the other side of the rotor via these longitudinal bores and transverse bores in the rotor shaft 601. The air can take its further route, already described, via the grooves 306 in the bearing bush for the rotor in order to be guided to the low-pressure side of the pump chamber P.

A transport of the air through a center bore of the shaft 601 makes it necessary to produce the center bore and possibly the transverse bore, which is expensive. Furthermore, it must be taken into account that the bores result in other properties of the shaft as compared to a shaft 601 made from solid material. This consideration of the other properties of the shaft can result in additional expense.

For the first to fourth pumps according to the figures, other variants are therefore chosen.

In the case of the first pump in an area of the rotor between the shaft and the permanent magnet, first through holes 603 and second through holes 607 are provided. The first through holes 603 extend parallel to the shaft 601 in an area directly adjacent to the shaft 601. The second through holes 604 are radially further away from the rotor shaft 601 and thus closer to the permanent magnet 607.

The first through holes 603 have the advantage that they begin more in the center of the rotation and thus more in the center of the collecting air. This ensures that no large air bubble forms. However, the first through holes 603 have the disadvantage that the rotor body 602, which includes the permanent magnet 607 and through which the rotor shaft is guided, is weakened by the first through holes 603 in an area in which little material is available. This leads to small wall thicknesses of the rotor body 602 in the area of the first through holes 603, which must be particularly taken into account. The rotor body 602 is preferably made of plastic.

The second through holes 604 are surrounded by more material, which has structural advantages over the first through holes 603. In contrast, the air cannot be discharged through the second through holes 604 as well as through the first through holes 603.

Figure 6:
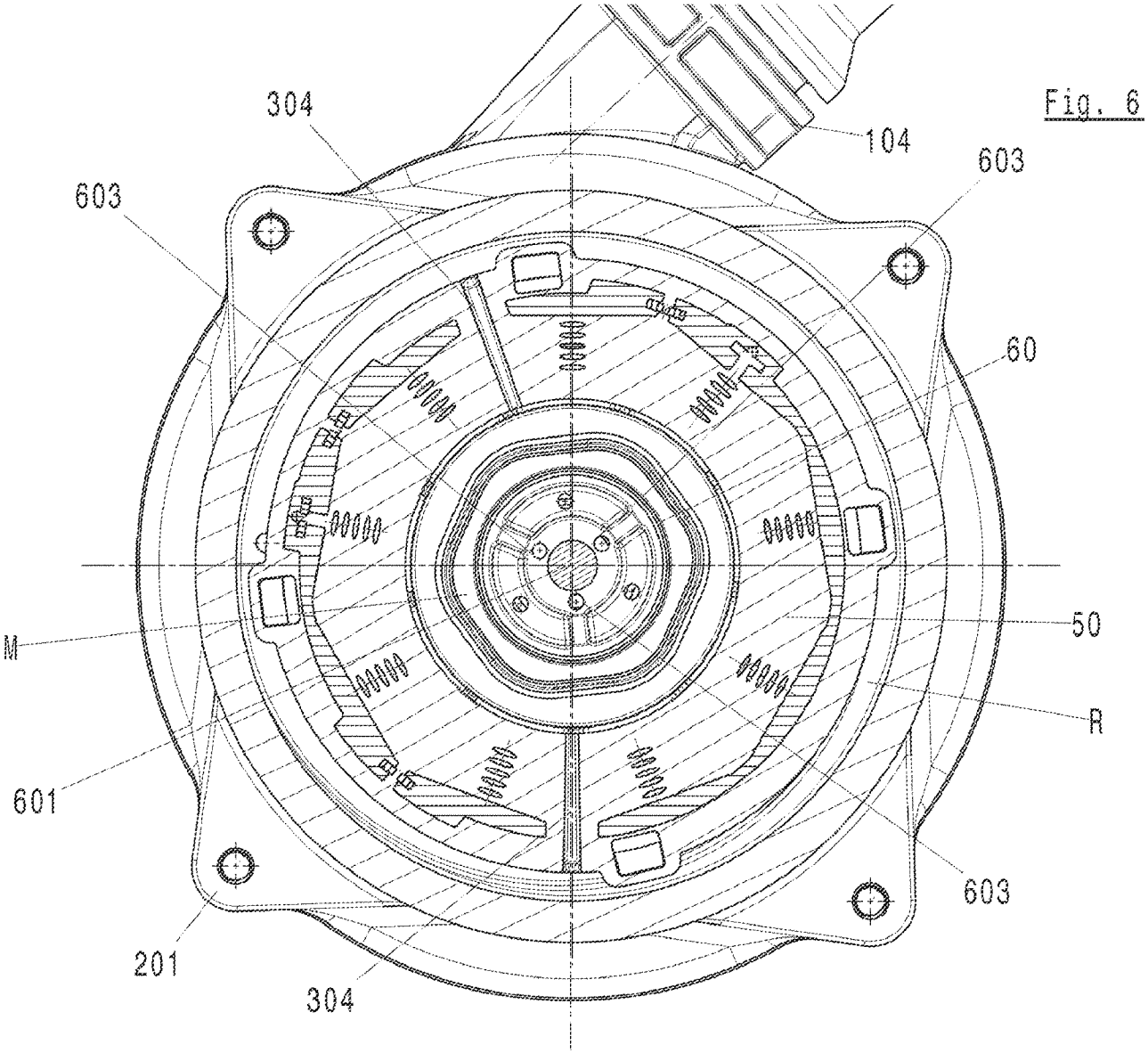
FIG. 6 is a cross section through the second pump according to the invention.
Figure 7:
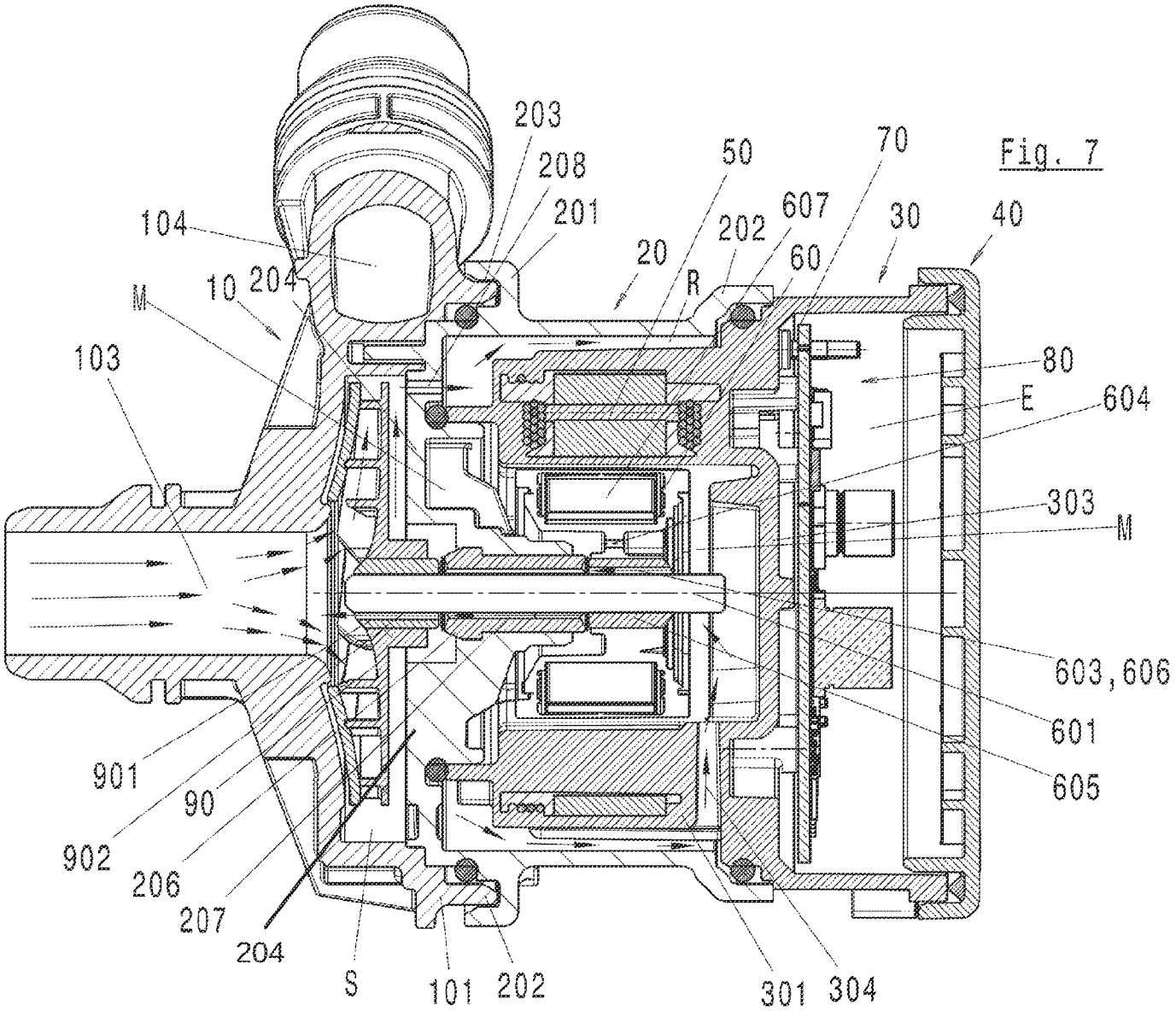
FIG. 7 is a longitudinal section through a third pump according to the invention.
Figure 8:
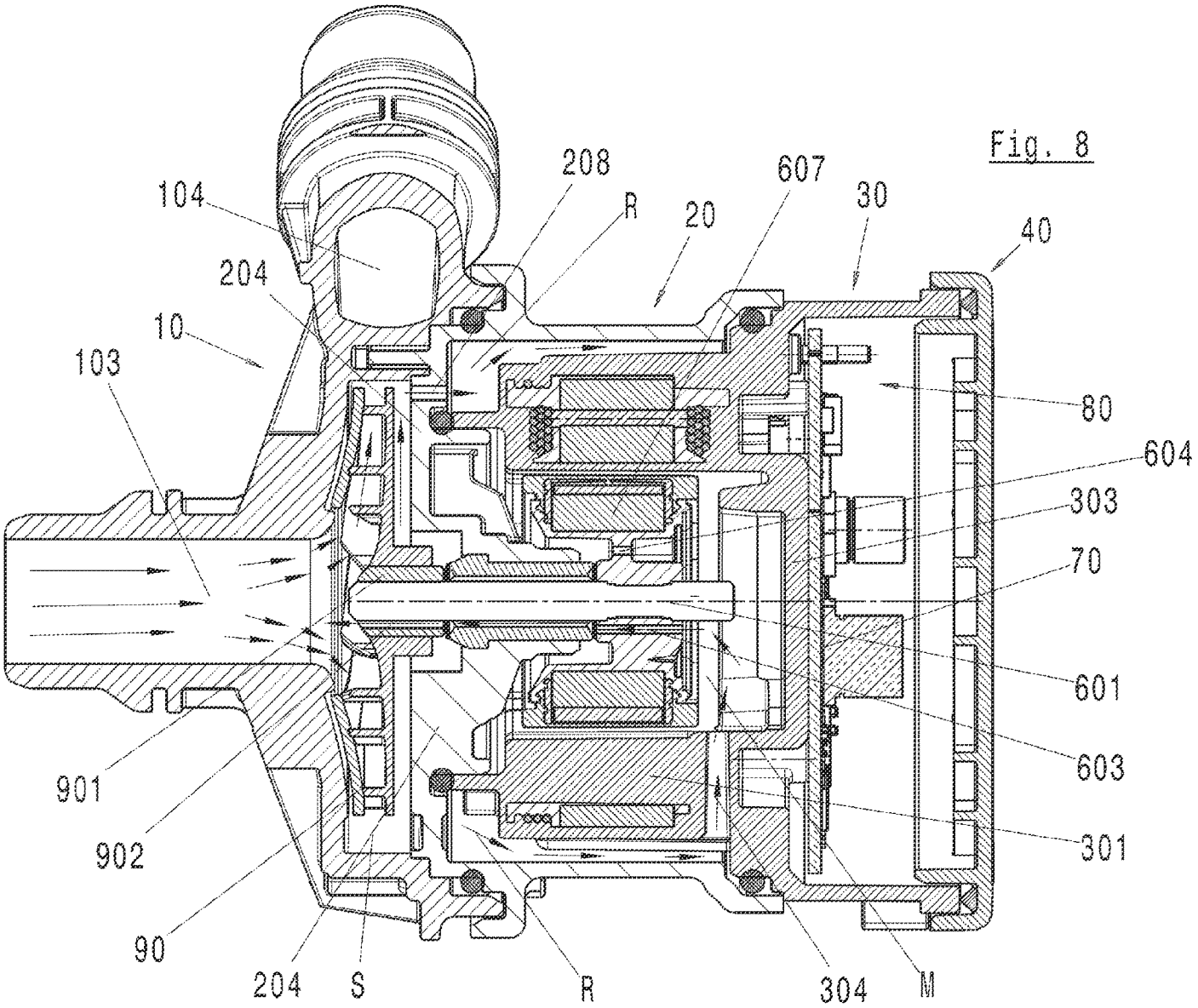
FIG. 8 is a longitudinal section through a fourth pump according to the invention.
Figure 9:
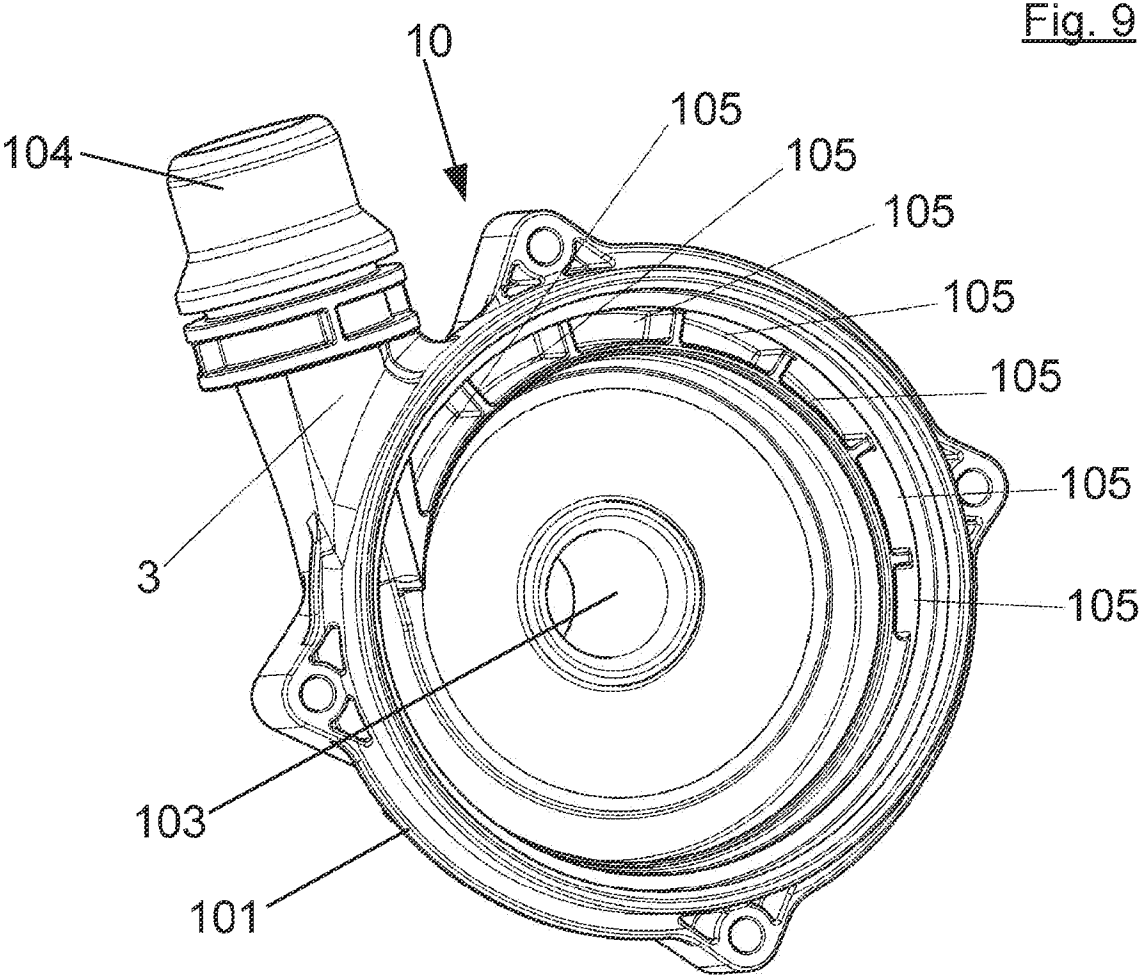
FIG. 9 is a perspective view of a pump housing of one of the four depicted pumps according to the invention and FIG. 10 is a cross section through one of the four pumps shown.
Figure 10:
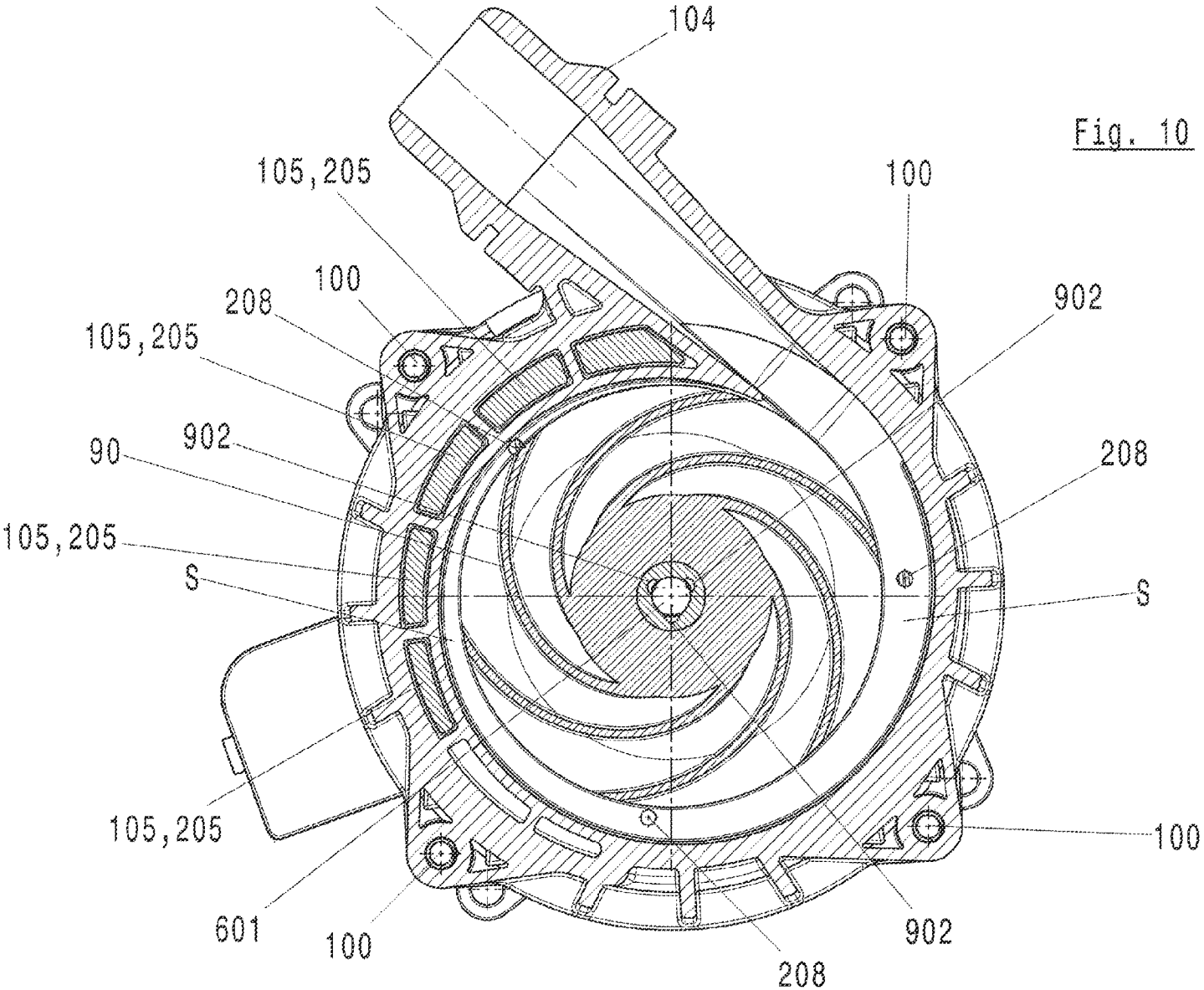

It is possible that in pumps according to the invention, the first and second through holes 603, 604, as shown for the first inventive pump (FIGS. 3 and 4) and the fourth inventive pump (FIG. 8), only the first through holes 603, as shown for the second inventive pump (FIGS. 5 and 6), or only the second through holes 604 are provided.

The first and fourth pumps differ, among other things, by the rotor shaft 601. While the second pump has a smooth, circular cylindrical shaft 601, the rotor shaft 601 of the fourth pump has constrictions and shoulders which improve connection between the shaft and the rotor body 602 which envelops the permanent magnet 607.

The third pump has a different solution in terms of through holes for venting the space between rotor 60 and end wall 303 of electronics housing 30. For this solution, a bush 605 is provided between the rotor body 602 and the shaft 601, which corresponds to the bush 901 of the impeller 90 and is preferably identical to the bush 901 of the impeller 90. The shaft 601 is smooth and cylindrically circular. By using identical bushes 605, 901 for the impeller 90 and the rotor 60, that is to say by using identical parts, several advantages can be achieved. On the one hand, grooves 902, 606 for the coolant flow can be achieved in the rotor 60, as in the case of the impeller 90, which are guided close to the rotor shaft 601. For the coolant flow through the rotor 60, this offers the possibility of improved ventilation without the shaft 601 having to be specially designed. The grooves allow for through holes, which are guided very close to the axis of rotation, without the rotor body 602 enveloping the permanent magnet 607 having to be weakened in an area in which there is little material.

An advantageous feature of the fourth inventive pump, which can also be provided in all other inventive pumps, is that the side of the end wall 303 of the electronics housing 30 facing away from the motor chamber M is flat. This makes it possible for the interconnect device 70 carrying the electronic circuit 80 to rest flat against this side of the end wall 303. The interconnect device 70 can preferably be glued to this side of the end wall 303, preferably with an adhesive that conducts heat in a special way, thus transporting circulated fluid from the circuit 80 or the interconnect device 70 on the one side via the end wall 303 into the motor chamber M. Fixing by other means could then be omitted. If detachable fastening of the interconnect device in the electronics housing is preferred, this can be done using a detachable fastener. In order to still be able to achieve good heat transfer from the interconnect device 70 into the end wall 303, a thermal paste can be provided between the interconnect device 70 and the end wall 303.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A pump for a fluid circuit in a vehicle, the pump comprising:

a multi-part housing that has a pump chamber; and an impeller arranged in the pump chamber;

wherein a pump housing and a further housing part of the multi-part housing bound the pump chamber, wherein the pump housing and the further housing part each have a flange with a flange surface that rest against one another, wherein one of the two flange surfaces has at least one annular groove and the other of the two flange surfaces has at least one circumferential web, which engages in the annular groove, wherein a wall of the pump housing that bounds the pump chamber in a radial direction is provided with recesses that open in an axial direction toward the further housing part, and wherein each of the recesses have different dimensions from one another, and wherein the flange of the pump housing and the flange of the further housing part each have at least one through hole, the at least one through hole of the pump housing being aligned with the at least one through hole of the further housing part and wherein a screw engages in the at least one through hole of the pump housing and the at least one through hole of the further housing part to connect the pump housing and the further housing part together.

2. The pump according to claim 1, wherein the flange surface of the pump housing is provided with the at least one circumferential web.

3. The pump according to claim 2, wherein the flange surface of the further housing part is provided with the at least one annular groove.

4. The pump according to claim 3, wherein the flange of the pump housing and the flange of the further housing part are fastened to one another by screws.

5. The pump according to claim 1, wherein the at least one annular groove and the at least one circumferential web form a labyrinth seal in a radial direction.

6. The pump according to claim 1, wherein the pump is a coolant pump.

7. The pump according to claim 1, wherein a wall of the further housing part that faces the pump housing is provided with protrusions, wherein the protrusions protrude into the recesses of the pump housing and wherein each of the protrusions has a shape that is complementary to only a respective one of the recesses, such that the pump housing and the further housing part can only be assembled together in one specific position.

* * * * *